United States Patent [19]

Sanchez

[11] 4,368,613

[45] Jan. 18, 1983

[54] TAPE WRAPPED CONDUCTOR

[75] Inventor: Florencio Sanchez, Vineland, N.J.

[73] Assignee: InsCon Cable Inc., Bridgeton, N.J.

[21] Appl. No.: 285,818

[22] Filed: Jul. 22, 1981

Related U.S. Application Data

[62] Division of Ser. No. 205,943, Nov. 12, 1980, abandoned.

[51] Int. Cl.[3] ..... H01B 13/06; D07B 1/14; D07B 1/16

[52] U.S. Cl. ..... 57/11; 57/3; 174/36

[58] Field of Search ..... 57/3, 6, 9, 11, 15, 57/31; 174/36, 103, 108, 105

[56] References Cited

U.S. PATENT DOCUMENTS

| | | | |
|---|---|---|---|
| 1,782,381 | 11/1930 | Dunsheath | 57/15 |
| 3,714,769 | 2/1973 | Tsuchiya | 57/3 |
| 3,794,750 | 2/1974 | Garshick | 174/36 |

*Primary Examiner*—Donald Watkins
*Attorney, Agent, or Firm*—Friedman, Goodman & Teitelbaum

[57] ABSTRACT

An apparatus for producing a tape wrapped conductor by advancing and rotating the conductor as it moves from a source reel to a take up reel. Successively positioned adjacent the moving conductor are a first tape having an aluminum foil thereon, a drain wire, and an outer insulating tape, so that the tapes and the drain wire are drawn into a spiral wrap in successive overlying relationship by the advancing and moving conductor. The first tape is applied with its aluminum foil side facing outwardly of the conductor and toward the drain wire.

9 Claims, 2 Drawing Figures

TAPE WRAPPED CONDUCTOR

This is a division, of application Ser. No. 205,943 filed Nov. 12, 1980, now abandoned.

BACKGROUND OF THE INVENTION

This invention relates to a tape wrapped conductor, and to apparatus for producing such tape wrapped conductor.

An electrical conductor is generally assembled by means of a tape wrapped about the conductor. In some cases, more than one conductor is utilized, in which case each of the conductors are individually insulated by an extruded insulation and are then combined by a suitable tape wrapping about the combined conductors. A drain wire may also be placed about the tape wrapped conductors and the composite may then be further covered with an outer protective coating.

One example of this type of electric conductor assembly is described in U.S. Pat. No. 4,041,237 which describes utilizing two insulated wire conductors which are protected with a helically wound tape having an aluminum foil layer facing the conductors and a mylar layer facing outward of the conductors. A drain wire is disposed within the tape against the aluminum layer, and an outer insulation jacket is extruded onto the tape.

Various types of apparatus are available for placing the various insulators on the conductors. For example, in U.S. Pat. No. 3,756,004 there is provided a tape wrapping apparatus where the wire is advanced from a supply to a take up reel. Tape is fed to the advancing wire through pinch rollers which are driven by a speed drive mechanism which is adjusted under control of the advancing wire. The rate of drive of the pinch rollers is coordinated with the tape feed whereby the tape is supplied at a proper rate to the advancing wire.

Although such apparatus may be effective for a single layer of tape, problems arise when overlying layers of tapes are required for the composite conductor cable assembly. It becomes difficult to coordinate and integrate the speed of the tape drive to properly place the desired layer of tape with the proper overlap onto the previous conductor assembly. This problem is further complicated when it is realized that overlying layers of tape become thicker and accordingly the speed of the tape drive must correspondingly be adjusted. The situation is made more difficult when a type of cable assembly is utilized which includes a drain wire since the drain wire is wrapped about the assembly, and accordingly the tape overlying such drain wire cannot be applied with a uniform speed.

Accordingly, there is need for an apparatus which can apply various layers of tape, drain wire, etc. onto conductors in suitable successive steps to achieve a single composite tape wrapped conductor assembly.

Other problems existing with prior art tape wrapped conductors concern the possibility of shorts occurring between the shield and the conductor. Where the tape includes an aluminum foil layer, and the aluminum foil layer is placed adjacent to the conductor, there exists the problem of shield-to-conductor shorts, the lack of pair-to-pair isolation causing the conductor assembly to malfunction.

SUMMARY OF THE INVENTION

It is accordingly an object of the present invention to provide an apparatus for producing a tape wrapped conductor which avoids the aforementioned problems of prior art devices.

Another object of the present invention is to provide an apparatus which applies various layers of spiral wrapped tape, overlying each other, in a single pass of the conductor through the apparatus.

A further object of the present invention is to provide an apparatus which applies a first spiral tape about the conductor, a drain wire wrapped around the taped conductor, and an outer tape wrapped about the composite conductor assembly, all in a single pass of the conductor through the apparatus.

Still another object of the present invention is to provide an apparatus for producing tape wrapped conductors utilizing the rotation and advancement of the conductors to spiral wrap the tape about the conductors.

Another object of the present invention is to provide an apparatus for tape wrapping a conductor wherein the tape is drawn from a spool into a spiral wrap about the conductor by means of the advancement and rotation of the conductor, and wherein suitable tension is applied onto the tape reel to maintain the tape under tension.

Still another object of the present invention is to provide an apparatus for producing a tape wrapped conductor wherein the tape reel is positioned at approximately 90° with respect to the advancing conductor and with the reel axis perpendicular to the conductor advance path.

Yet a further object of the present invention is to provide an apparatus for producing a tape wrapped conductor assembly wherein the tape is drawn from a tape spool at approximately 90° with respect to the advancing tape and is directed about a guide into a half-twist position at an angle of approximately 45° with respect to the direction of the advancement of the conductor.

A further object of the present invention is to provide an apparatus for producing a tape wrapped conductor assembly having a tape reel supplying an aluminum sided insulating tape wherein the tape is applied with the aluminum side facing away from the conductor, and wherein a drain wire is applied over the aluminum side.

Another object of the present invention is to provide an apparatus for producing a tape wrapped conductor assembly whereby two or more insulated conductors are paired together by twisting of the conductors and wherein the twisting and the advancement of the conductors are utilized to draw in the tape into a spiral wrap thereabout.

A further object of the present invention is to provide an electric cable having one or more conductor wires and having an aluminum coated insulating tape spirally wound about the conductor wire with the aluminum side facing outwardly of the wire and toward a drain wire.

Briefly, in accordance with the present invention, there is provided an apparatus for producing tape wrapped conductors. The apparatus including a driving mechanism for longitudinally advancing and rotating a conductor from a source reel to a take up reel. Tape supplies are utilized for supplying a first insulating tape and a second insulating tape. Positioned between the tape supplies is a reel supplying a drain wire. As the conductor is rotatingly advanced, it draws the tapes and drain wire into a spiral wrap about the conductor in suitable overlying relationship with each other utilizing the movement of the conductor to draw in the tape and drain wire to provide the respective spiral wrap of these layers.

In an embodiment of the present invention, the tape reels are provided at approximately a 90° angle to the direction of advance of the conductor. A guide is utilized for turning the wire about an axis perpendicular to the wire whereby the wire is applied with a half-twist at an angle of 45° onto the conductor.

In a further embodiment of the invention, the first tape includes an aluminum foil coating on the tape, and the tape is applied with the aluminum side facing outwardly of the conductor, whereby it will be in contact with the drain wire lying about the aluminum surface.

Using the present apparatus, a first aluminum faced insulating tape, followed by a drain wire, and finally by an outer insulating tape are successively applied in a single pass over at least one conductor while the conductor is advanced and rotated. When two or more insulated conductors are utilized, they are twisted together, and the various layers of tape and drain wire are drawn and spirally wound onto the insulated conductor by means of the twisting and advancement of the conductors.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
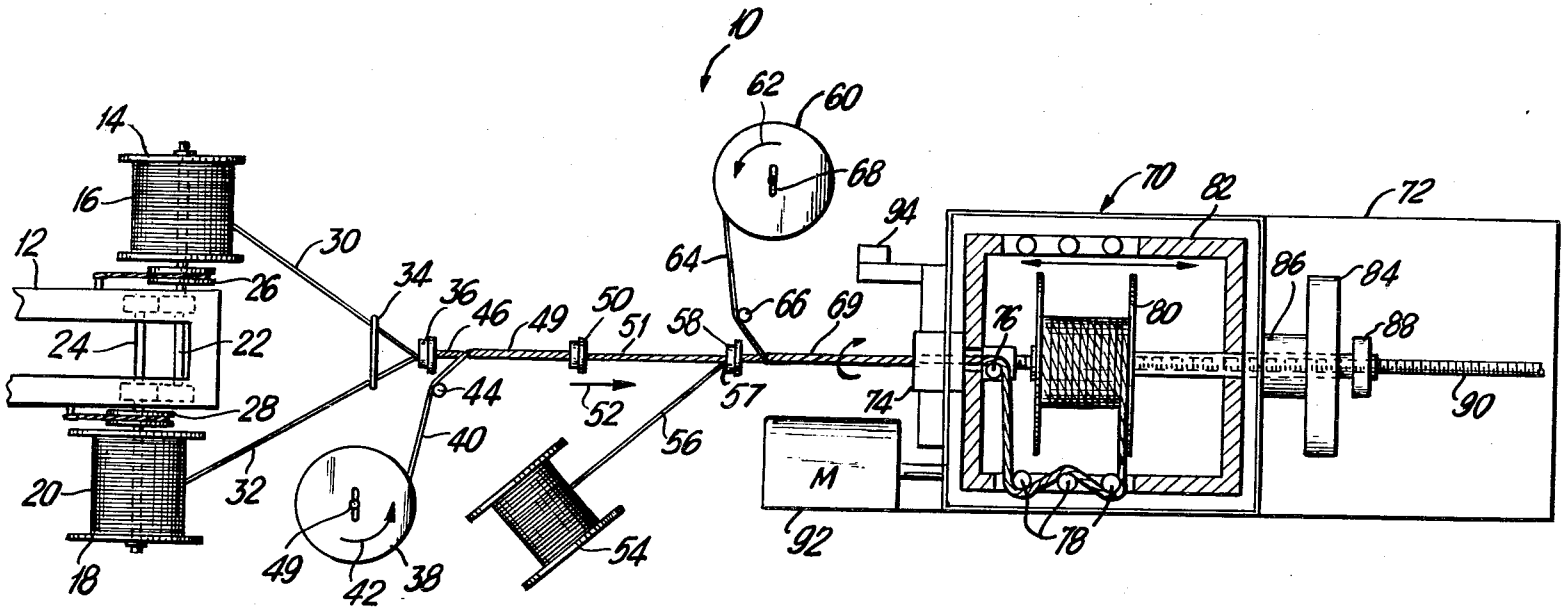
FIG. 1 is a schematic plan view, partially broken away, of the apparatus of the present invention.

Referring now to FIG. 1, the apparatus of the present invention is shown generally at 10 and includes a stationary payoff stand 12 on which are connected a first reel 14 containing an insulated conductor wire 16 wound thereon, and a second reel 18 containing a second insulated conductor wire 20. Each of the reels are mounted by means of the respective axles 22, 24 which are suitably positioned on the payoff stand 12 in accordance with mechanisms well known in the art. A conventional tension brake 26 is coupled onto axle 22 for applying suitable tension on the insulated conductor wire 16 extending therefrom. A corresponding conventional tension brake 28 is provided on axle 24 for control of the tension on conductor wire 20.

The insulated conductor wires 16, 20 are respectively drawn as single conductor wires 30, 32 from the supply reels 14, 18 and are passed through a spreader plate 34 and are then passed to a closing die 36. As will hereinafter be explained, the conductor wires are then advanced longitudinally and are also rotated, so that as the two conductor wires 30, 32 pass through the closing die 36, they are paired and twisted together by means of the advancement and the rotational movement to form a two-wire conductor 46. The brakes 26, 28 apply constant tension to the insulated conductor wires being paired together.

A tape supply reel 38 is positioned on a suitable payoff stand (not shown). The supply reel 38 is located with its vertical axis perpendicular to the direction of advancement of the conductor wires, and is positioned at approximately 90° with respect to the advancing longitudinal direction of the conductor wire, indicated by the arrow 52. A tape 40 is drawn from the reel 38 causing the reel 38 to unwind in the direction shown by the arrow 42. The tape 40 is drawn around the spindle guide 44 having an axis perpendicular to the directional movement (arrow 52) of the conductors. The tape 40 is drawn so that the flat side or width of the tape faces the wires 30, 32 as it is pulled around the spindle guide 44, it being turned on the axis of the spindle guide which is perpendicular to the wires. The tape 40 is then applied with a half-twist at approximately a 45° angle onto the twisted two-wire conductor 46.

The tape 40 is drawn in and applied in a spiral wrap by means of the longitudinal advancement and rotation of the conductor 46. In this manner, there is no drive applied to the tape 40 to specifically feed it to the conductor 46. On the other hand, the tape 40 is drawn in by means of the natural pairing together and twisting of the two wires 30, 32. A variable tension arrangement is provided on the tape reel 38 to maintain suitable tension on the tape 40. This tension can be provided by adjusting a wing nut 48 on top of the tape reel 38 thereby applying or releasing spring pressure applied by a conventional clutch type brake (not shown) located at a fixed position on the payoff stand supporting the tape reel 38.

The tape 40, which is typically applied, is a commercially available two-ply laminated aluminum foil and polyester film. The tape is spirally wrapped with the aluminum foil side 49 up over the paired conductor wires 30, 32 of the conductor 46. An overlap of approximately $\frac{1}{8}$ inch ensures continuous shielding of the paired conductor wires 30, 32. The shielded pair of conductor wires pass through a sizing die 50 in order to form the aluminum foil over the insulated conductor wires. The conductor wires 30, 32 with the tape 40 around them defines a shielded conductor 51 which continues to proceed in the longitudinal direction of advancement shown by the arrow 52.

A reel 54 of conventional drain wire 56 is provided adjacent to the longitudinal direction of travel. The drain wire 56 is pulled from the reel 54 and is applied over the foil 49 of the shielded conductor 51 through a guide 57 provided at the base of the next sizing die 58. Typically, either a bare or a tinned copper drain wire can be utilized. The drain wire can also be pulled in by means of the advancement and the rotation of the shielded conductor 51.

A second tape reel 60 is provided and is also positioned at approximately 90° with respect to the longitudinal direction of travel (arrow 52) of the shielded conductor 51. The reel 60 has its central axis perpendicular to the longitudinal direction of travel of the shielded conductor 51. The reel 60 is caused to rotate in the direction shown by the arrow 62. An outer commercially available insulating tape, typically a 1 mil clear polyester film tape 64, is pulled from the reel 60 at a direction approximately perpendicular to the longitudinal direction of advancement of the shielded conductor 51. The tape 64 passes around a spindle guide 66 having its axis perpendicular to the longitudinal direction of travel (arrow 52) of the shielded conductor 51. The tape 64, passing about the spindle guide 66, has its flat side or width facing the shielded conductor 51. After the tape 64 has been turned on the axis of the spindle guide 66, it is then applied onto the shielded conductor 51 and the drain wire 56 with a half-twist at approximately a 45° angle. Again, suitable tension can be applied by means of a variable tension applied at a fixed position on the payoff stand (not shown) supporting the reel 60, in a similar manner as the tension is applied to the above mentioned reel 38. The operator can control the amount of tension on the tape 64 by tightening or loosening a wing nut 68 on top of the tape reel. The tape 64 is typically wound on the shielded conductor 51 with approximately a ⅛ inch overlap to form a taped assembly 69.

The taped assembly 69 passes through a buncher, shown generally at 70, which provides the uniform twist and tightens both spirally wrapped tapes. The taped assembly 69 enters the cabler housing 72 through a front bearing mounted in the bearing housing 74 from where it first passes around a pulley 76 and then passes around additional pulleys 78 from where it is finally wound into a take up reel 80. The cylindrical cabler winding flyer 82 is caused to rotate about its axis by means of the drive gear 84 which is coupled to the winding flyer 82 through a rear cabler bearing mounted in the bearing housing 86. This winding causes the pulling of the conductors 30, 32 and the rotational movement thereof.

At the same time there is provided reciprocating longitudinal movement of the reel 80 by means of a take up reel transverse gear 88 which reciprocates along the worm gear take up reel shaft 90 in a conventional manner well known in the art. Both the reciprocating movement of the reel 80 and the rotational movement of the flyer 82 are controlled by means of the motor 92. There is also provided a conventional lay control mechanism 94 on the front of the cabler housing 70.

With the apparatus as shown, there is provided onto a pair of insulated conductor wires a first insulating tape which spiral wraps the insulated conductor wires, a drain wire about the first insulating tape and an outer insulating tape covering over the assembly. All these are applied simultaneously during a single operation while the conductor wires are being twisted. Typically the first layer will be the aluminum foil and polyester film tape, and the second layer will be the clear polyester tape.

Although the apparatus is shown and described in connection with a pair of insulated conductor wires, a similar apparatus and similar benefits can be achieved when applied to a single conductor wire. As the single conductor wire is rotated and advanced, it will also pull in the tape into a spiral wrap, as well as the drain wire. Similarly, the mechanism could be applied not only for two conductor wires being paired, but a number of conductor wires such as triads, quads, etc.

The positioning of the tapes with respect to the conductor wires have been found beneficial. Specifically, by positioning the tapes so that they are drawn at approximately a 90° angle to the direction of movement of the conductor wires, and then guiding them about a spindle to permit them to be twisted, it has been found that the pull of the conductor wires itself is sufficient to suitably spiral wrap the tapes. Suitable tension can be applied on the tape reels to control the amount of overlap, and the suitability of the wrapping.

Furthermore, it has been found that with this arrangement it is not necessary to separately drive the tapes and separately coordinate the driving of the tapes with the advancement of the conductor wires.

Figure 2:
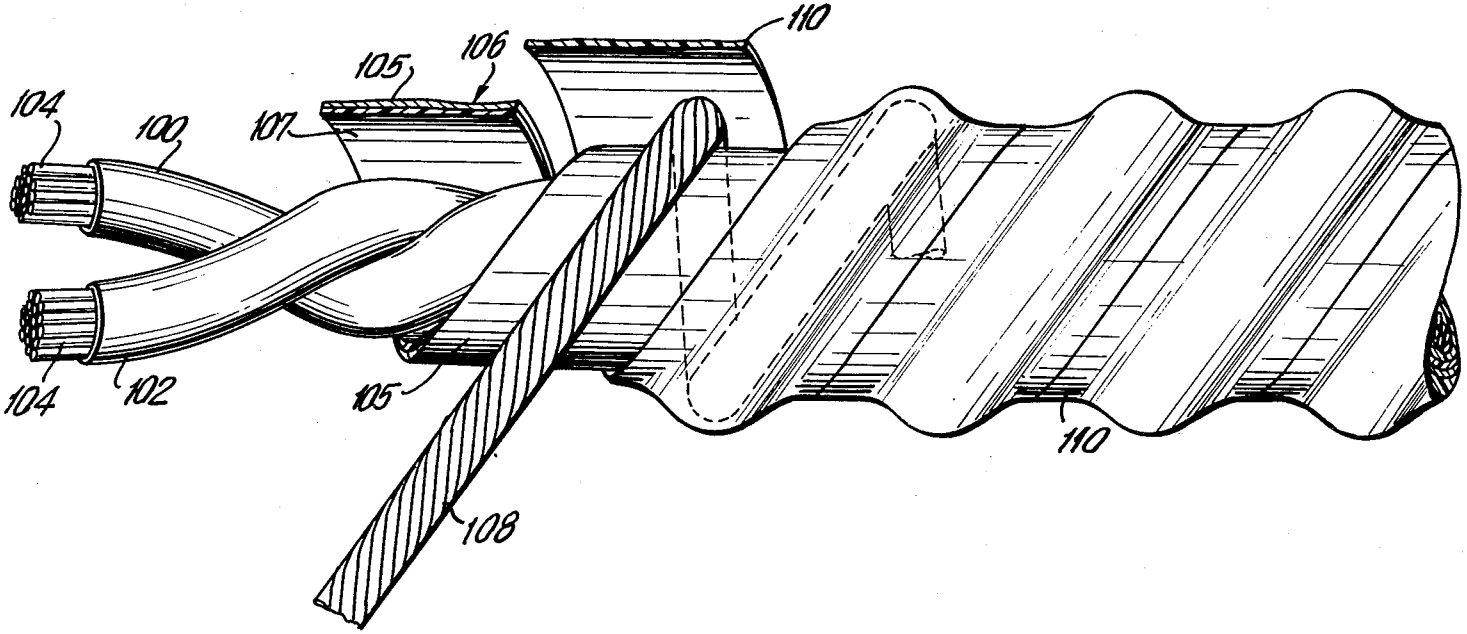
FIG. 2 is a perspective view, partially broken away, of the tape wrapped conductor in accordance with the present invention.

Referring now to FIG. 2, there is shown a typical conductor assembly including the insulated conductors 100, 102 each of which contains a plurality of individual wires 104. The two insulated conductors 100, 102 are paired together and are covered with a first insulating layer formed of the spiral wrapped tape 106 to provide a shielded conductor. Typically, such tape would be the two-ply laminated aluminum foil and polyester film. This tape is applied with the aluminum foil side 105 facing outwardly of the insulated conductors, and the polyester film side 107 disposed against the insulated conductors. The drain wire 108 is then applied onto the shielded conductor, and on the outside thereof is finally applied the outer insulating tape covering 110, typically being the clear polyester film. All of these are spirally wrapped with suitable overlap to provide continuous coverage.

By spiral wrapping the first tape with the aluminum foil side up, it has been found that continuous contact with the drain wire can be ensured. This provides a safeguard against shield-to-conductor shorts and guarantees pair-to-pair isolation when combined with application of polyester tape. By placing the aluminum side up, the drain wire will be suitably insulated on both sides and maintained away from the conductors with suitable insulating layers thereabout.

Of course, the same embodiment shown in FIG. 2 could also be accomplished with more than two insulated conductors as well as with a single conductor.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An apparatus for producing a tape wrapped conductor, comprising:

first means for both rotating and longitudinally advancing a conductor from a source reel to a take up reel;

second means for supplying a first insulating tape, a drain wire, and a second insulating tape at respective successive locations with respect to the advancing conductor; and third means for drawing said first insulating tape, said drain wire and said second insulating tape successively into a spiral wrap about the conductor in an overlying relationship with each other by utilizing the rotating and advancing movement of the conductor to provide the spiral wrap.

2. An apparatus as in claim 1, wherein said first means includes a winding flyer rotatable with respect to the take up reel for advancing and rotating the conductor, pulley means for passing the tape wrapped conductor to the take up reel under winding control of the winding flyer, and tension brake means positioned with respect to the source reel for maintaining a selected tension on the conductor.

3. An apparatus as in claim 1, wherein said second means includes a tape reel supplying one of said tapes, said tape reel being positioned with respect to the conductor such that the tape thereon is pulled off the tape reel at an approximately 90° angle to the direction of the advance of the conductor, and guide means for applying the tape at an approximately 45° angle to the conductor.

4. An apparatus as in claim 3, and including means for half twisting the tape as it is applied to the conductor.

5. An apparatus as in claim 3, and further including a variable tension control means positioned with respect to said tape reel for maintaining tension on the tape.

6. An apparatus as in claim 2, and further including reciprocating means for longitudinally reciprocating the take up reel to thereby wind the tape wrapped conductor across the take up reel.

7. An apparatus as in claim 1, wherein said second means includes a drain wire reel for supplying said drain wire, a sizing die for receiving therethrough both said conductor and said drain wire to facilitate positioning of the drain wire about the conductor.

8. An apparatus as in claim 1, and comprising at least two source reels of insulated conductors, and closing means for joining the insulated conductors therethrough, whereby said first means twists the conductors together as they pass through said closing means.

9. An apparatus as in claim 1, wherein said first insulating tape includes an aluminum foil layer, said second means supplying said first insulating tape to the conductor with the aluminum foil layer facing outwardly of the conductor so that the drain wire will be spirally wrapped in contact with the aluminum foil layer.

* * * * *